US007511678B2

(12) United States Patent
Wu

(10) Patent No.: US 7,511,678 B2
(45) Date of Patent: Mar. 31, 2009

(54) HIGH-POWER DUAL-FREQUENCY COAXIAL FEEDHORN ANTENNA

(75) Inventor: Te-Kao Wu, Rancho Palos Verde, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 379 days.

(21) Appl. No.: 11/361,350

(22) Filed: Feb. 24, 2006

(65) Prior Publication Data

US 2008/0297428 A1 Dec. 4, 2008

(51) Int. Cl.
*H01Q 13/00* (2006.01)

(52) U.S. Cl. ..... 343/786

(58) Field of Classification Search ..... 343/786, 343/772, 773, 783, 789
See application file for complete search history.

(56) References Cited

U.S. PATENT DOCUMENTS 4,658,258 A 4/1987 Wilson
5,087,896 A 2/1992 Wen et al.
5,552,797 A * 9/1996 Cook ..... 343/786
6,163,304 A 12/2000 Peebles et al.
6,208,309 B1 * 3/2001 Chandler et al. ..... 343/786
6,208,310 B1 3/2001 Suleiman et al.
6,278,407 B1 8/2001 Ashjaee et al.
6,473,053 B1 10/2002 Krishmar-Junker et al.
6,504,514 B1 1/2003 Toland et al.
6,577,283 B2 6/2003 Wu et al.
6,639,461 B1 10/2003 Tam et al.
6,647,158 B2 11/2003 Betts et al.
6,657,516 B1 12/2003 Junker et al.
6,673,667 B2 1/2004 Gorrell et al.
6,759,992 B2 * 7/2004 Knop et al. ..... 343/786
6,864,850 B2 * 3/2005 Imaizumi et al. ..... 343/776
6,965,128 B2 11/2005 Holm et al.
7,034,774 B2 * 4/2006 Kuo et al. ..... 343/909
2004/0222934 A1 11/2004 Wu
2004/0227596 A1 11/2004 Nguyen et al.

OTHER PUBLICATIONS

Classification of Polarization; http://230nsc1.phy-astr.gsu.edu/hbase/phyopt/polclas.html; pp. 1-4.

Such, H.Paul: "Care and Feeding of a SETI Dish"; http://seti1.setileague.org/hardware/feedchok.htm; pp. 1-5.

W1GHZ Microwave Antenna Book Online: http://www.w1ghz.org; Chapters 6.3.4 Chaparral™ feed; and Chapter 6.9.5 Dual-band Mixed Horns.

"Simple Small Primary Feed for Large Opening Angles and High Aperture Efficiency"; Electronics Letters, Sep. 21, 1972, vol. 8, No. 19, pp. 474-476.

(Continued)

*Primary Examiner*—Huedung Mancuso
(74) *Attorney, Agent, or Firm*—Tarolli, Sundheim, Covell & Tummino LLP

(57) ABSTRACT

Systems are disclosed for providing substantially equal E-plane and H-plane radiation patterns in a high power and dual band coaxial feedhorn antenna for a satellite communication system. One embodiment may include a coaxial feedhorn antenna comprising an outer coaxial horn portion for propagation of first signals and an inner horn portion for propagation of second signals. The coaxial feedhorn antenna may also comprise a conductive choke-ring coupled to the outer conductive wall, the conductive choke-ring being coaxial with the outer coaxial horn portion and the inner horn portion. The conductive choke-ring provides substantially equal E-plane and H-plane radiation patterns of the first signals and substantially reduced back-lobes.

28 Claims, 4 Drawing Sheets

OTHER PUBLICATIONS

Elbert, Bruce, et al.: "Simulating the Performance of Communication Links with Satellite Transponders"; http:/www.applicationstrategy.com/Communications_simulation.htm; pp. 1-11.

"CP Horn with Septum Polarizer"; Circular Polarized Feedhorn; 2 pgs.

* cited by examiner

HIGH-POWER DUAL-FREQUENCY COAXIAL FEEDHORN ANTENNA

This invention was made with Government support under Contract No. NM071041 awarded by National Aeronautics and Space Administration. The Government has certain rights in this invention.

TECHNICAL FIELD

This invention relates generally to communications and, more particularly, to a high-power dual-frequency coaxial feedhorn antenna.

BACKGROUND

Deep space exploration satellite systems require high power, high gain antenna systems for transmitting data from the satellite back to a ground station located on the Earth. For example, the United States (US) National Aeronautics and Space Administration (NASA) is planning the development and launching of a Jupiter Icy Moons Orbiter (JIMO) to explore the nature and extent of habitable environments in the solar system. One of the main objectives of such a mission is to detect and analyze a wide variety of chemical species, including chemical elements, salts, minerals, organic and inorganic compounds, and possible biological compounds, in the surface of Jupiter's icy moons. The data collected needs to be transmitted over a dual band (e.g., Ka/X-band) at a high data rate.

Satellite systems are typically equipped with antenna systems including a configuration of antenna feeds that transmit and/or receive circularly polarized uplink and/or downlink signals. Typically, the antenna systems include one or more arrays of feedhorns, where each feedhorn array may include an antenna reflector for collecting and directing the signals. In order to reduce weight and conserve the satellite real estate, some satellite communications systems may use the same antenna system and array of feedhorns to receive the circularly polarized uplink signals and transmit the circularly polarized downlink signals. To effectuate more efficient transmissions, circularly polarized signals should be provided with substantially equal E-plane and H-plane radiation patterns and a reduced back-lobe. Otherwise, the signals propagating between a transmit antenna and a receive antenna may experience a loss of communication link power from becoming elliptically polarized through having a large axial ratio and from leaking radiated power through back-lobes. Table 1, below, demonstrates examples of the loss of communication link power (i.e., loss of gain) that can result from having large axial ratios. For example, as demonstrated in Table 1, if the space antenna has an axial ratio of 4 dB, the communication link to a perfect circularly polarized ground antenna loses 0.22 dB of gain. It is to be understood that the loss of communication link power demonstrated in Table 1 below is referring to one antenna (transmit or receive) having an axial ratio greater than 0 dB communicating with another antenna (transmit or receive) that has perfect circular polarization, thus having an axial ratio of 0 dB.

TABLE 1

| Axial Ratio (dB) | Gain Loss (dB) |
|---|---|
| 1 | 0.01 |
| 1.5 | 0.03 |
| 2 | 0.06 |

TABLE 1-continued

| Axial Ratio (dB) | Gain Loss (dB) |
|---|---|
| 3 | 0.13 |
| 4 | 0.22 |
| 5 | 0.33 |
| 10 | 1.04 |
| 15 | 1.72 |
| 20 | 2.23 |

Many feedhorn antennas have been designed with features to specifically negate power loss caused by a back-lobe and a large axial ratio, such as by including iris pins or corrugated inner surfaces. However, during high-power transmissions, such designs often experience arcing through the accumulation of charge, thus breaking down. As such, these designs are often insufficient for high-power transmissions.

SUMMARY

One embodiment of the present invention may include a coaxial feedhorn antenna for a satellite communication system. The coaxial feedhorn antenna may comprise an outer conductive wall and an inner conductive wall coaxial with the outer conductive wall. The inner conductive wall and the outer conductive wall define an outer coaxial horn portion for propagation of first signals therebetween, and the inner conductive wall defines an inner horn portion for propagation of second signals within the inner conductive wall, the outer coaxial horn portion and the inner horn portion each comprising an aperture at an end portion of the coaxial feedhorn antenna. The coaxial feedhorn antenna may also comprise a conductive choke-ring coupled to the outer conductive wall, the conductive choke-ring being coaxial with the outer conductive wall and the inner conductive wall. The conductive choke-ring provides substantially equal E-plane and H-plane radiation patterns of the first signals and substantially reduced back-lobes.

Another embodiment may include a satellite communication system. The satellite communication system may comprise a plurality of coaxial feedhorn antennas, each of the plurality of coaxial feedhorn antennas being operative to receive uplink signals and transmit downlink signals. At least one of the coaxial feedhorn antennas may comprise an outer coaxial horn portion operative to propagate first signals, an inner horn portion operative to propagate second signals, the inner horn portion being coaxial with the outer coaxial horn portion, and a choke-ring coupled to the outer coaxial horn portion, the choke-ring being coaxial with the inner horn portion and the outer coaxial horn portion. The conductive choke-ring provides substantially equal E-plane and H-plane radiation patterns of the first signals and substantially reduced back-lobes.

Another embodiment may include a coaxial feedhorn antenna for a satellite communication system. The coaxial feedhorn antenna may comprise an outer conductive wall and an inner conductive wall coaxial with the outer conductive wall. The inner conductive wall and the outer conductive wall define an outer coaxial horn portion for propagation of first signals therebetween, and the inner conductive wall defines an inner horn portion for propagation of second signals within the inner conductive wall, the outer coaxial horn portion and the inner horn portion each comprising an aperture at an end portion of the coaxial feedhorn antenna. The coaxial feedhorn antenna may also comprise a plurality of conductive choke-rings, the plurality of conductive choke-rings being coaxial with the outer conductive wall and the inner conductive wall. Each of the plurality of conductive choke-rings may comprise an end wall and an annular side wall. The end walls and the annular side walls define a plurality of annular cavities having an opening that shares an axial direction with the aperture of each of the outer coaxial horn portion and the inner horn portion. The plurality of conductive choke-rings provide substantially equal E-plane and H-plane radiation patterns of the first signals and substantially reduced back-lobes.

DETAILED DESCRIPTION

The present invention relates generally to a high power dual-frequency coaxial feedhorn antenna and, more particularly, to a dual-frequency coaxial feedhorn antenna on a satellite that employs one or more choke-rings to provide substantially equal E-plane and H-plane patterns. Uplink signals received at the coaxial feedhorn antenna and downlink signals transmitted from the coaxial feedhorn antenna may induce a current flow on the exterior of the outer feedhorn antenna. The induced current-flow results in back-lobes as well as a large axial ratio from unequal E-plane and H-plane radiation patterns to the circularly polarized uplink and downlink signals. As such, the signals may experience communication link power loss. A plurality of choke-rings or a choke-ring with one or more annular cavities can be included on the outer feedhorn antenna to provide a high impedance that suppresses the induced current-flow, therefore providing substantially equal E-plane and H-plane radiation patterns and substantially reduced back-lobes.

Figure 1:
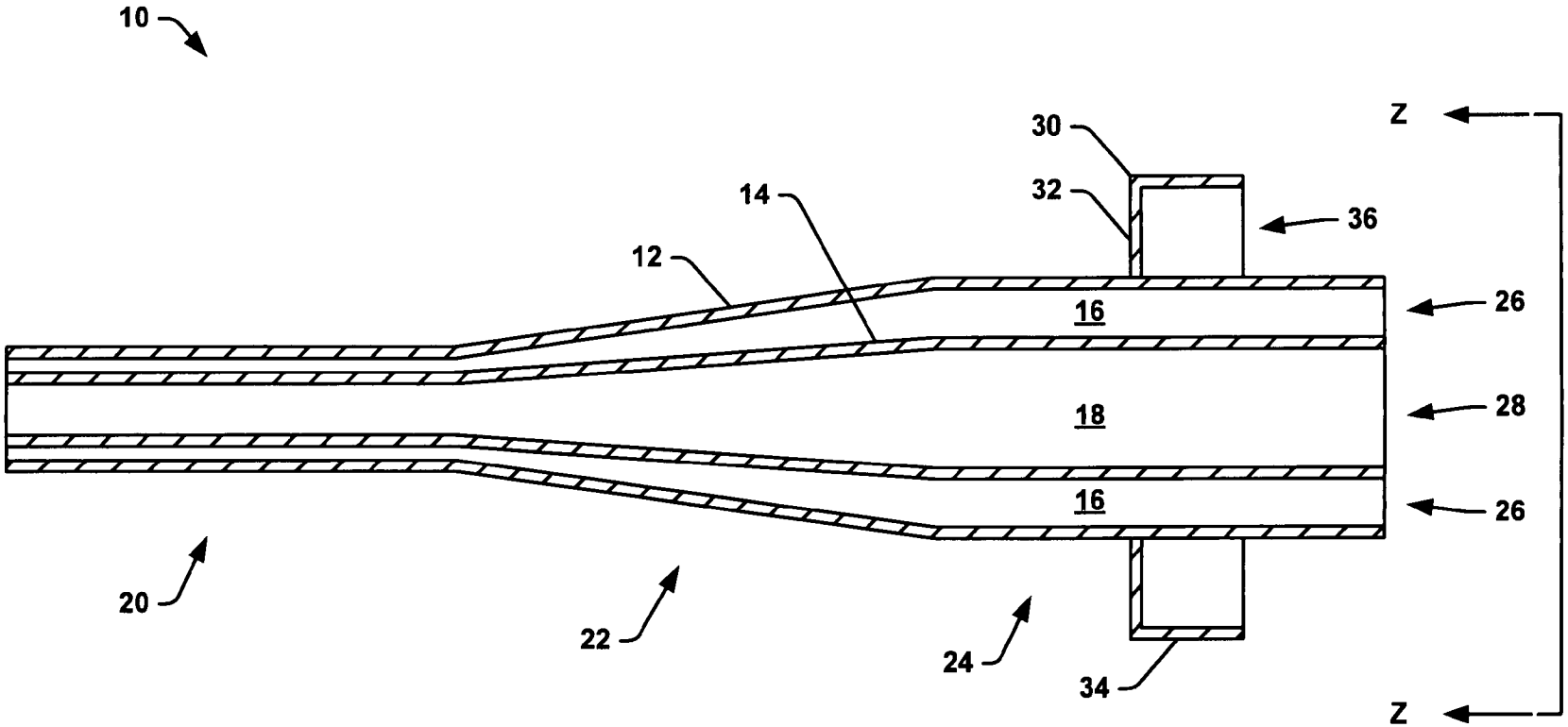
FIG. 1 illustrates an example of a length-wise cross-sectional view of a coaxial feedhorn antenna for a satellite antenna system in accordance with an aspect of the invention.

FIG. 1 illustrates a length-wise, cross-sectional view of a coaxial feedhorn antenna 10 for a satellite antenna system in accordance with an aspect of the invention. The coaxial feedhorn antenna 10 receives satellite uplink and downlink signals at particular frequency bands. For example, the coaxial feedhorn antenna 10 may transmit and/or receive signals at both the X-band (e.g., approximately 8-12 GHz) and the Ka-band (e.g., approximately 26-40 GHz). It is to be understood that the coaxial feedhorn antenna 10 could be part of an array of feeds arranged in a desirable manner depending on the particular application. The antenna system may employ reflectors and the like for collecting and directing the uplink and downlink signals depending on the particular application. By employing the coaxial feedhorn antenna 10 as discussed in the example of FIG. 1, separate antenna systems are not needed for each of the satellite uplink and downlink signals. Accordingly, valuable space on the satellite can be conserved and the weight of the satellite can be reduced.

The coaxial feedhorn antenna 10 includes an outer conductive wall 12 and an inner conductive wall 14. It is to be understood that both the outer conductive wall 12 and the inner conductive wall 14 can be formed of a variety of different suitably conductive materials. The outer conductive wall 12 and the inner conductive wall 14 are coaxial and define an outer coaxial horn portion 16 and an inner horn portion 18. The coaxial feedhorn antenna 10 includes a first cylindrical section 20, a tapered section 22 that expands the diameter of the coaxial feedhorn antenna 10 from the first cylindrical section 20, and a second cylindrical section 24 at a distal end of the coaxial feedhorn antenna 10. The outer coaxial horn portion 16 includes an aperture 26 and the inner horn portion 18 includes an aperture 28, each of the apertures 26 and 28 being located at an end portion of the second cylindrical section 24. The coaxial feedhorn antenna 10 can be coupled at an end portion of the first cylindrical section 20 to a coaxial waveguide structure (not shown) interconnecting the coaxial feedhorn antenna 10 to a coaxial transition (not shown). Alternatively, the coaxial feedhorn antenna 10 can be coupled at the end portion of the first cylindrical section 20 directly to the coaxial transition.

Uplink signals can be received by the outer coaxial horn portion 16 at the aperture 26 and propagate into the second cylindrical section 24, the tapered section 22, and the first cylindrical section 20 to a coaxial transition. Similarly, downlink signals to be transmitted from the outer coaxial horn portion 16 propagate from a coaxial transition, through the first cylindrical section 20, the tapered section 22, and the second cylindrical section 24, and are radiated from the aperture 26. It is to be understood that uplink and downlink signals could also propagate through a coaxial waveguide of an interposing coaxial waveguide structure between the coaxial transition and the outer coaxial horn portion 16. It is also to be understood that suitable reception and transmission devices can be provided to separate uplink signals and downlink signals into respective portions of the respective frequency bands. For example, in the X-band of operation, a diplexer could allocate a frequency of approximately 7.5 GHz for downlink signals and approximately 8.4 GHz for uplink signals.

In addition to the uplink and downlink signals propagated through the outer coaxial horn portion 16, uplink signals can be received by the inner horn portion 18 at the aperture 28 and propagate into the second cylindrical section 24, the tapered section 22, and the first cylindrical section 20 to a transition. Similarly, downlink signals to be transmitted from the outer coaxial horn portion 16 propagate from a transition through the first cylindrical section 20, the tapered section 22, and the second cylindrical section 24 and are radiated from the aperture 28. The uplink signals and downlink signals propagated by the inner horn portion 18 can be signals of a higher frequency relative to the uplink and downlink signals propagated by the outer coaxial horn portion 16. It is to be understood that uplink and downlink signals could also propagate through an inner waveguide of an interposing coaxial waveguide structure between the transition and the inner horn portion 18. It is also to be understood that suitable reception and transmission devices can be provided, similar to that described above, to separate uplink signals and downlink signals into respective portions of the respective frequency bands. For example, in the Ka-band of operation, a diplexer could allocate a frequency of approximately 32 GHz for downlink signals and approximately 34 GHz for uplink signals.

The coaxial feedhorn antenna 10 can be configured to propagate the respective dual-band uplink and downlink signals at high power. To achieve high power propagation, the coaxial feedhorn antenna 10, and related upstream feed structures, such as a transition and/or interposing coaxial waveguide structure, can be configured to propagate the signals at high power without arcing. For a suitable high-power application, the minimum gap between any conductors in the coaxial feedhorn antenna 10, as well as any of the related upstream feed structures, can be at least the vertical dimension of a rectangular waveguide structure that feeds high power orthogonally polarized signals to and from the inner horn portion 18 to avoid arcing. As an example, a WR-28 conductive waveguide having a vertical dimension of 0.14 inches can be used to feed high power signals to and from the inner horn portion 18. Therefore, the minimum spacing between conductors in the coaxial feedhorn antenna 10, as well as any related upstream feed structures, can be substantially equal to or greater than 0.14 inches. With such an arrangement, the inner horn portion 18 of the coaxial feedhorn antenna 10 can be configured to transmit and/or receive Ka-band signals propagated at a continuous wave (CW) power of, for example, up to 5500 watts.

A given waveguide can be excited for wave propagation without significant signal attenuation if a given propagated wave has a frequency that is greater than the cutoff frequency $f_C$, which can be a function of the cross-sectional dimensions of a given waveguide. However, a corresponding feedhorn antenna can have an aperture that is greater than the waveguide for the purpose of better impedance matching and for illuminating a reflector to achieve proper edge-taper without too much spill-over loss. As such, designers of waveguides and corresponding feedhorn antennas are conscientious of size constraints for performance.

As an example, the size of the aperture 28 of the inner horn portion 18 could be sized appropriately for a diameter that is substantially equal to one free-space wavelength of the respective frequency band of operation. In the above described example of the inner horn portion 18 propagating in the Ka-band, the diameter of the aperture 28 is substantially equal to one free-space wavelength $\lambda_{Ka}$ of the Ka-band. Sizing the aperture 28 of the inner horn portion 18 substantially equal to the single free-space wavelength $\lambda_{Ka}$ can result in substantially equal E-plane and H-plane radiation patterns for the uplink and downlink signals that are propagated through the inner horn portion 18. However, the outer coaxial horn portion 16 is a coaxial waveguide, which has substantially different propagation properties as applicable to the determination of a cutoff frequency $f_C$ and to an aperture size for illuminating a reflector to achieve proper edge-taper. Additionally, as in the above described example of the outer coaxial horn portion 16 propagating in the X-band, the X-band has a free-space wavelength $\lambda_X$ that is substantially greater than that of the free-space wavelength $\lambda_{Ka}$ of the Ka-band (e.g., $\lambda_X \approx 4*\lambda_{Ka}$). As such, the aperture 26 of the coaxial outer coaxial horn portion 16 may not be properly sizable to avoid an induced current flow in the outer conductive wall 12, and still provide proper reflector illumination without much spillover-loss. As such, uplink and downlink signals propagating through the outer coaxial horn portion 16 have a large axial ratio, and thus experience a substantial back-lobe and substantially unequal E-plane and H-plane radiation patterns. Therefore, uplink and downlink signals propagated through the outer coaxial horn portion 16 may experience communication link power loss.

Figure 2:
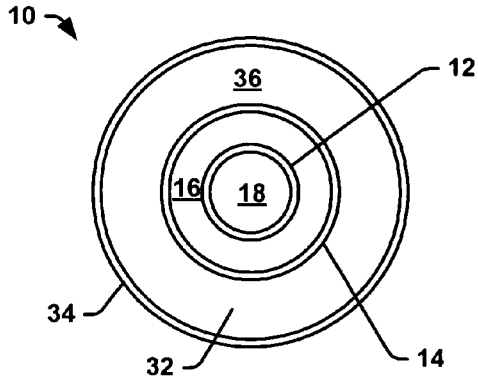
FIG. 2 illustrates a partial plan view of the coaxial feedhorn antenna for a satellite antenna system of FIG. 1 in accordance with an aspect of the invention.

To suppress the current flow in the outer conductive wall that results in the back-lobe and the large axial ratio, the coaxial feedhorn antenna 10 includes a conductive choke-ring 30. The conductive choke-ring 30 is coupled to the outer conductive wall 12 and is coaxial with the outer conductive wall 12 and the inner conductive wall 14. In the example of FIG. 1, the conductive choke-ring 30 is situated external to the outer coaxial horn portion 16. The conductive choke-ring 30 can be fabricated such that it is integral with the outer conductive wall 12, or could be conductively coupled in another manner. The conductive choke-ring 30 includes an end wall 32 and an annular side wall 34. The end wall 32, the annular side wall 34, and the outer conductive wall 12 define an annular cavity 36. The annular cavity 36 has an opening that shares an axial direction with each of the apertures 26 and 28. FIG. 2 illustrates a front view (as viewed in the Z-direction depicted in FIG. 1) of the coaxial feedhorn antenna 10, such that it can be further demonstrated that the conductive choke-ring 30 is concentric with the inner horn portion 18 and the outer coaxial horn portion 16.

Referring back to FIG. 1, the annular cavity 36 of the conductive choke-ring 30 can be sized a specific depth to provide an optimum operating frequency band of the coaxial feedhorn antenna 10. For example, the annular cavity 36 can have a depth approximately equal to $\lambda_X/4$, and thus can provide an optimum operating frequency band, for X-band signals having a free-space wavelength of approximately $\lambda_X$. Additionally, because the conductive choke-ring 30 is a solid construction that is continuously conductively coupled to the outer conductive wall 12, the conductive choke-ring 30 is capable of providing substantially reduced back-lobe as well as substantially equal E-plane and H-plane radiation patterns at high-powered transmissions. For example, the conductive choke-ring 30 may provide substantially equal E-plane and H-plane radiation patterns and a substantially reduced back-lobe for X-band circularly polarized uplink and/or downlink signals propagating through the outer coaxial horn portion 16 while Ka-band circularly polarized uplink and/or downlink signals propagate through the inner horn portion 18 at up to 5500 watts CW power without arcing, such as could occur through the use of iris pins or corrugated inner surfaces.

It is to be understood that the example of FIG. 1 is but one example of a coaxial feedhorn antenna with a choke-ring. The example of FIG. 1 is therefore not intended to be limiting, and other such examples can also be implemented in accordance with an aspect of the invention. For example, the annular cavity 36 of the conductive choke-ring 30 is not limited to a depth of $\lambda_X/4$, but that other depths are possible that could provide optimum operating frequency bands for the coaxial feedhorn antenna 10.

Figure 3:
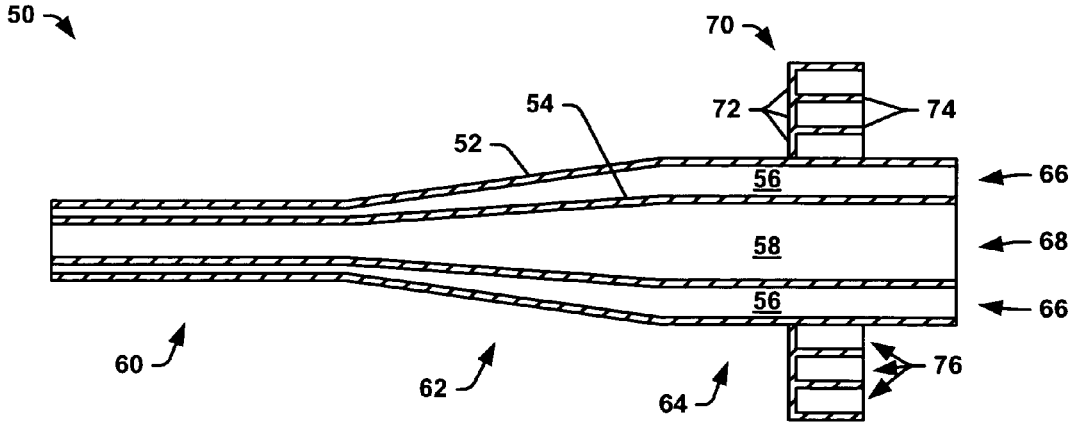
FIG. 3 illustrates another example of a length-wise cross-sectional view of a coaxial feedhorn antenna for a satellite antenna system in accordance with an aspect of the invention.

FIG. 3 illustrates a length-wise, cross-sectional view of a coaxial feedhorn antenna 50 for a satellite antenna system in accordance with an aspect of the invention. The coaxial feedhorn antenna 50 receives satellite uplink and downlink signals at particular frequency bands, such as the X-band and the Ka-band. It is to be understood that the coaxial feedhorn antenna 50 could be part of an array of feeds arranged in a desirable manner depending on the particular application. The antenna system may employ reflectors and the like for collecting and directing the uplink and downlink signals depending on the particular application. By employing the coaxial feedhorn antenna 50 as discussed in the example of FIG. 3, separate antenna systems are not needed for each of the satellite uplink and downlink signals. Accordingly, valuable space on the satellite can be conserved and the weight of the satellite can be reduced.

The coaxial feedhorn antenna 50 includes an outer conductive wall 52 and an inner conductive wall 54. It is to be understood that both the outer conductive wall 52 and the inner conductive wall 54 can be formed from a variety of suitably conductive materials. The outer conductive wall 52 and the inner conductive wall 54 are coaxial and define an outer coaxial horn portion 56 and an inner horn portion 58. The coaxial feedhorn antenna 50 includes a first cylindrical section 60, a tapered section 62 that expands the diameter of the coaxial feedhorn antenna 50 from the first cylindrical section 60, and a second cylindrical section 64 at the output of the coaxial feedhorn antenna 50. The outer coaxial horn portion 56 includes an aperture 66 and the inner horn portion 58 includes an aperture 68. Each of the apertures 66 and 68 are located at an end portion of the second cylindrical section 64. The coaxial feedhorn antenna 50 can be coupled at an end portion of the first cylindrical section 60 to a coaxial waveguide structure (not shown) interconnecting the coaxial feedhorn antenna 50 to a coaxial transition (not shown). Alternatively, the coaxial feedhorn antenna 50 can be coupled at the end portion of the first cylindrical section 60 directly to the coaxial transition.

Uplink signals can be received by the outer coaxial horn portion 56 at the aperture 66 and propagate into the second cylindrical section 64, the tapered section 62, and the first cylindrical section 60, and through an inner waveguide of an interposing coaxial waveguide structure to a coaxial transition, or straight into the coaxial transition. Similarly, downlink signals to be transmitted from the outer coaxial horn portion 56 propagate from a transition, and possibly through an inner waveguide of an interposing coaxial waveguide structure, through the first cylindrical section 60, the tapered section 62, and the second cylindrical section 64 and are radiated from the aperture 66. It is to be understood that suitable reception and transmission devices can be provided to separate uplink signals and downlink signals into respective portions of the respective frequency bands, such as a transition and a diplexer.

In addition to the uplink and downlink signals propagated through the outer coaxial horn portion 56, uplink signals can be received by the inner horn portion 58 at the aperture 68 and propagate into the second cylindrical section 64, the tapered section 62, and the first cylindrical section 60, and through an outer coaxial waveguide of an interposing coaxial waveguide structure to a coaxial transition, or straight into the coaxial transition. Similarly, downlink signals to be transmitted from the outer coaxial horn portion 56 propagate from a transition, and possibly through an outer coaxial waveguide of an interposing coaxial waveguide structure, through the first cylindrical section 60, the tapered section 62, and the second cylindrical section 64 and are radiated from the aperture 68. The uplink signals and downlink signals propagated by the inner horn portion 58 can be signals of a higher frequency relative to the uplink and downlink signals propagated by the outer coaxial horn portion 56. It is to be understood that suitable reception and transmission devices can be provided, similar to that described above, to separate uplink signals and downlink signals into respective portions of the respective frequency bands, such as a transition and a diplexer.

To suppress the current flow in the outer conductive wall that results in the substantial back-lobe and large axial ratio, the coaxial feedhorn antenna 50 includes a plurality of concentric conductive choke-rings 70. Similar to the example of FIG. 1, each of the conductive choke-rings 70 are coaxial with the outer conductive wall 52 and the inner conductive wall 54, and are coupled external to the outer conductive wall 52. Also similar to the example of FIG. 1, each of the conductive choke-rings 70 includes an end wall 72 and annular side walls 74. As demonstrated in the example of FIG. 3, each of the conductive choke-rings 70 shares at least one of the annular side walls 74 with another of the conductive choke-rings 70. Accordingly, the annular side walls 74 and the end walls 74 define a plurality of annular cavities 76. Each of the annular cavities 76 has an opening that shares an axial direction with each of the apertures 66 and 68, such that each of the annular cavities 76 is concentric with the inner horn portion 58 and the outer coaxial horn portion 56.

To achieve high power propagation, the coaxial feedhorn antenna 50, and related upstream feed structures, such as a transition and/or interposing coaxial waveguide structure, can be configured to propagate the signals at high power without arcing. For example, the minimum gap between any conductors in the coaxial feedhorn antenna 50, as well as any of the related upstream feed structures, can be at least the vertical dimension of a rectangular waveguide structure (e.g., a WR-28 waveguide structure) that feeds high power orthogonally polarized signals to and from the inner horn portion 58 to avoid arcing. Additionally, because the conductive choke-rings 70 are continuously conductively coupled to the outer conductive wall 52, the conductive choke-rings 70 may provide substantially equal E-plane and H-plane radiation patterns and a substantially reduced back-lobe for X-band circularly polarized uplink and/or downlink signals propagating through the outer coaxial horn portion 16 while Ka-band circularly polarized uplink and/or downlink signals propagate through the inner horn portion 58 at up to 5500 watts CW power without arcing, such as could occur through the use of iris pins or corrugated inner surfaces.

Each of the annular cavities 76 of the conductive choke-rings 70 can be sized a specific and distinct depth to provide a broader bandwidth of the coaxial feedhorn antenna 50. For example, each of the annular cavities 38 can have a depth theoretically equal to a given $\lambda_X/4$, where $\lambda_X$ is one or more given free-space wavelengths in the X-band, and thus can provide a broader bandwidth. However, it is to be understood that, in a real-world application, each of the annular cavities 38 can have varying depths and can be sized differently based on a given application. It is also to be understood that the individually sized depths of the annular cavities 76 of the plurality of conductive choke-rings 70 can provide a broader bandwidth relative to the single choke-ring 30 for the coaxial feedhorn antenna 10 in the example of FIG. 1 above. Accordingly, the coaxial feedhorn antenna 50 can thus have an improved gain for X-band signals over a broader bandwidth.

It is to be understood that the example of FIG. 3 is but one example of a coaxial feedhorn antenna with a conductive choke-ring. The example of FIG. 3 is therefore not intended to be limiting, and other such examples can also be implemented. For example, the conductive choke-rings 70 may be formed integral with each other and with the outer conductive wall 52 of the coaxial feedhorn antenna 50, such that the conductive choke-rings 70 are actually a single conductive choke-ring 72 with a plurality of annular side walls 74 and a plurality of annular cavities 76. Alternatively, the conductive choke-rings 70 can be conductively attached or fastened to each other and to the outer conductive wall 52 of the coaxial feedhorn antenna 50 via a variety of different ways known in the art. Additionally, despite the example of FIG. 3 demonstrating three conductive choke-rings 70, a given coaxial feedhorn antenna can have as few or as many conductive choke-rings as practicably designable for a given coaxial feedhorn design.

Figure 4:
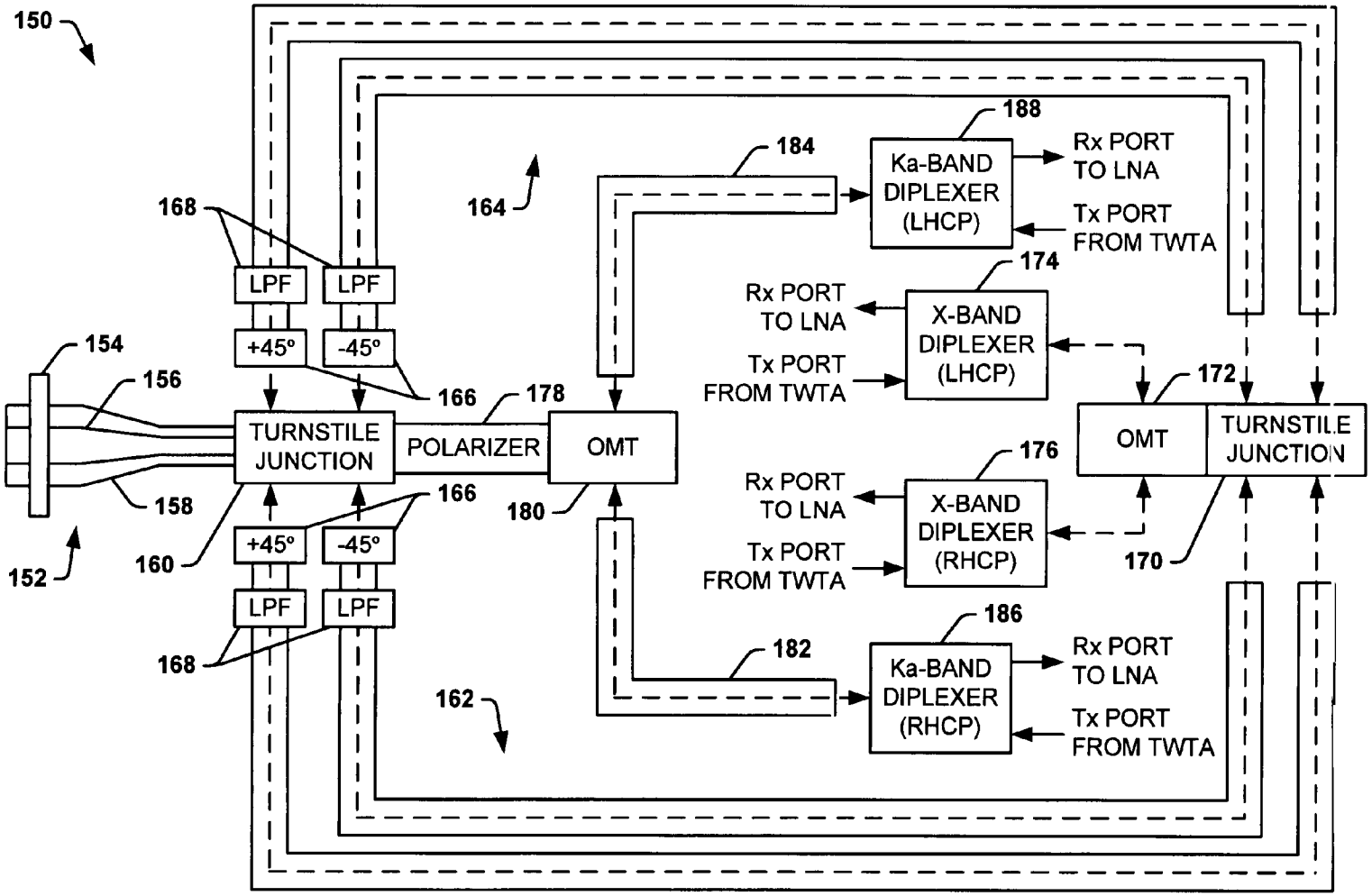
FIG. 4 illustrates an example of a coaxial feedhorn antenna feed system in accordance with an aspect of the invention.

FIG. 4 illustrates a coaxial feedhorn antenna feed system 150 in accordance with an aspect of the invention. The coaxial feedhorn antenna waveguide system 150 includes a coaxial feedhorn antenna 152. The coaxial feedhorn antenna 152 receives satellite uplink and downlink signals at particular frequency bands. For example, the coaxial feedhorn antenna 152 may receive uplink signals at both the X-band and the Ka-band and may transmit downlink signals at both the X-band and the Ka-band. It is to be understood that the coaxial feedhorn antenna 152 could be part of an array of feeds arranged in a desirable manner depending on the particular application. The antenna system may employ reflectors and the like for collecting and directing the uplink and downlink signals depending on the particular application. By employing the coaxial feedhorn antenna waveguide system 150 as discussed in the example of FIG. 4, separate antenna systems are not needed for each of the satellite uplink and downlink signals. Accordingly, valuable space on the satellite can be conserved and the weight of the satellite can be reduced.

The coaxial feedhorn antenna 152 can be cylindrical and can include a conductive choke-ring 154. The conductive choke-ring 154 can be, for example, a single choke ring having a single annular cavity, as described above with reference to FIGS. 1 and 2. Alternatively, the conductive choke-ring 154 can be, for example, a plurality of choke-rings, each defining a plurality of annular cavities having a distinct depth, such as demonstrated above in the example of FIG. 3. In either example, the conductive choke-ring 154 may operate to suppress the induced current flow and provide a substantially reduced back-lobe and substantially equal E-plane and H-plane radiation patterns, as described above regarding FIGS. 1-3. Additionally, because the conductive choke-ring 152 is a solid construction that is continuously conductively coupled to the outer conductive wall of the outer coaxial waveguide 156, the conductive choke-ring 152 is capable of providing a substantially reduced back-lobe and substantially equal E-plane and H-plane radiation patterns at high-powered transmissions (e.g., up to about 5500 watts CW power in the Ka-band) without arcing, such as could occur through the use of iris pins or corrugated inner surfaces.

The coaxial feedhorn antenna 152 can include an inner conductor 156 that is coaxial with an outer conductor 158, such that the inner conductor 156 and the outer conductor 158 define an inner horn portion and an outer coaxial horn portion, respectively. The inner horn portion can receive uplink signals and/or transmit downlink signals in the Ka-band. The outer coaxial horn portion can receive uplink signals and/or transmit downlink signals in the X-band. As is better described below, both uplink and downlink signals can be propagated through the coaxial feedhorn antenna 152 at high power.

In the example of FIG. 4, the coaxial feedhorn antenna feed system 150 includes a turnstile junction 160 that is operative to funnel both the uplink and downlink signals of the outer coaxial waveguide into four rectangular waveguides 162 and 164. It is to be understood that the coaxial feedhorn antenna 152 could be coupled to the turnstile junction 160 via an interposing coaxial waveguide structure (not shown). In the example of FIG. 4, the turnstile junction 160, along with ±45° phase shifters 166, can, for example, separate the circularly polarized X-band uplink signals of the outer coaxial horn portion into two orthogonally polarized signals. The orthogonally polarized signals can be propagated in the rectangular waveguides 162 and 164. The rectangular waveguides 162 and 164 could be, for example, WR-90 waveguides. Each of the orthogonally polarized signals passes through a respective low-pass filter (LPF) 168 and is fed to a turnstile junction 170. The turnstile junction 170 combines the orthogonally polarized uplink signals and feeds them to an orthomode transducer (QMT) 172, from which the signals are fed to a left-hand circular polarization (LHCP) X-band diplexer 174 and a right-hand circular polarization (RHCP) X-band diplexer 176. The X-band uplink signals could be output from the X-band diplexer 174 and the X-band diplexer 176 to a respective low-noise amplifier (LNA, not shown).

The turnstile junction 160 can also be operative to combine downlink signals for downlink transmission from the coaxial feedhorn antenna 154 via the outer coaxial horn portion. In the example of FIG. 4, X-band downlink signals can be generated from a respective source and traveling wave tube amplifier (TWTA) and can be input to the X-band diplexer 174 and the X-band diplexer 176, respectively. The X-band diplexers 174 and 176 can feed the signals to the OMT 172 and turnstile junction 170, which can convert the X-band downlink signals into two orthogonally polarized downlink signals and output them onto the rectangular waveguides 162 and 164. Each of the two orthogonally polarized downlink signals, after passing through the LPFs 168 and the ±45° phase shifters 166, are input to the turnstile junction 160 where they are combined into a circularly polarized downlink signal for downlink via the coaxial feedhorn antenna 154. The X-band diplexer 168 can also provide isolation between X-band uplink signals and X-band downlink signals, for example, by assigning different sections of the X-band to each (e.g., approximately 7.5 GHz for downlink signals and approximately 8.4 GHz for uplink signals).

In the example of FIG. 4, a polarizer 178 and an OMT 180 can convert the circularly polarized Ka-band uplink signals of the inner horn portion into two orthogonal linearly polarized signals (e.g., one associated with the right hand and the other with the left-hand circularly polarized signals). The orthogonally polarized signals are then propagated through rectangular waveguides 182 and 184 to a RHCP Ka-band diplexer 186 and a LHCP Ka-band diplexer 188, respectively. Accordingly, the Ka-band diplexers 186 and 188 can separate uplink and downlink signals into separate Ka-band frequencies (e.g., approximately 32 GHz for downlink signals and approximately 34 GHz for uplink signals). The rectangular waveguides 182 and 184 could be, for example, WR-28 waveguides. In an alternative arrangement, the coaxial feedhorn antenna feed system 150 could have a single Ka-band diplexer coupled through the polarizer 178 to the turnstile junction 160 without the OMT 180, such that Ka-band signals are propagated in only one of either right-hand circular polarization or left-hand circular polarization.

The coaxial feedhorn antenna 154 can be configured to propagate the respective dual-band uplink and downlink signals at high power. To achieve high power propagation, the coaxial feedhorn antenna feed system 150 can be configured to propagate the signals at high power without arcing. In the above described example of the rectangular waveguide structures 182 and 184 being WR-28 waveguides, the rectangular waveguide structures 182 and 184 could have a vertical dimension of 0.14 inches. Therefore, for a suitable high-power application, the minimum gap between conductors in the coaxial feedhorn antenna 152, the turnstile junction 160, the polarizer 178, and the OMT 180 can be substantially equal to or greater than 0.14 inches. With such an arrangement, the coaxial feedhorn antenna feed system 150, as well as the inner horn portion of the coaxial feedhorn antenna 154, can transmit and receive Ka-band signals propagated at up to 5500 watts CW power.

It is to be understood that, in the example of FIG. 4, additional communication components have been omitted and much component functionality has been simplified in the above discussion for the purpose of brevity. Accordingly, the example of FIG. 4 is but one example of a system employing a coaxial feedhorn antenna with a conductive choke-ring. The example of FIG. 4 is therefore not intended to be limiting, and other such examples can also be implemented in accordance with an aspect of the invention.

Figure 5:
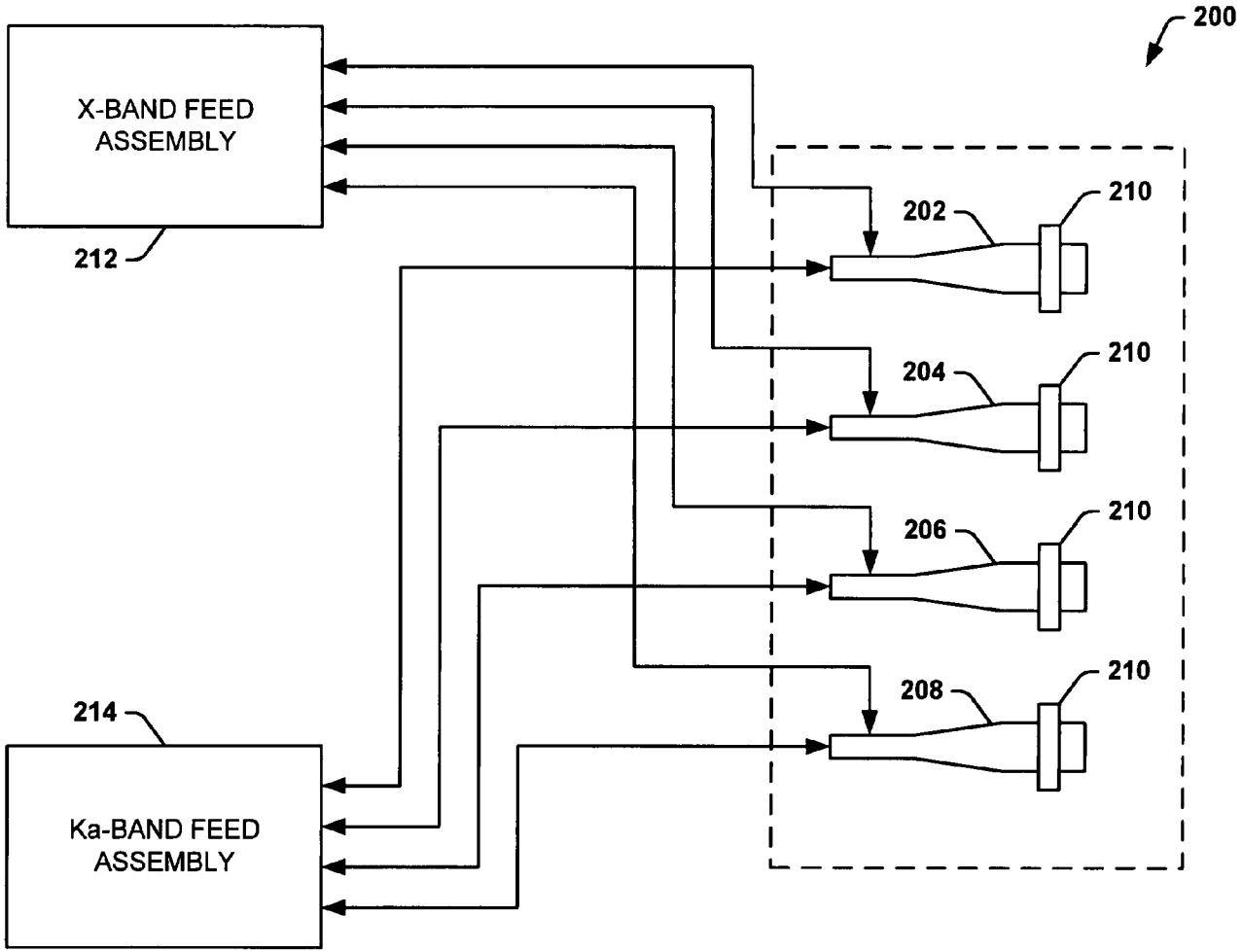
FIG. 5 illustrates another example of a coaxial feedhorn antenna feed system in accordance with an aspect of the invention.

FIG. 5 illustrates a coaxial feedhorn antenna feed system 200. The feedhorn antenna system 150 includes a first coaxial feedhorn antenna 202, a second coaxial feedhorn antenna 204, a third coaxial feedhorn antenna 206, and a fourth coaxial feedhorn antenna 208. Each of the coaxial feedhorn antennas 202, 204, 206, and 208 may receive uplink signals at least one of the X-band and the Ka-band and may transmit downlink signals at both the X-band and the Ka-band. The coaxial feedhorn antenna feed system 200 may employ reflectors (not shown) for collecting and directing the uplink and downlink signals depending on the particular application. Additionally, each of the coaxial feedhorn antennas 202, 204, 206, and 208 may include a conductive choke-ring 210 that may operate to suppress induced current flow on an outer conductive surface of an outer coaxial horn portion and provide substantially equal E-plane and H-plane radiation patterns as well as a substantially reduced back-lobe, as described above regarding FIGS. 1-3, in accordance with an aspect of the invention.

The coaxial feedhorn antenna feed system 200 diagrammatically demonstrates power reserves available to each of the coaxial feedhorn antennas 202, 204, 206, and 208. The coaxial feedhorn antenna feed system 200 includes an X-band feed assembly 212 and a Ka-band feed assembly 214. It is to be understood that each of the X-band feed assembly 212 and the Ka-band feed assembly 214 can include a plurality of high-power amplifiers that can be switched between the coaxial feedhorn antennas 202, 204, 206, and 208 to allocate their respective power. The X-band feed assembly 212 is demonstrated as coupled to the outer coaxial horn portion of each of the respective coaxial feedhorn antennas 202, 204, 206, and 208. It is to be understood that the coupling of the X-band feed assembly 212 is demonstrated with arrows for simplicity, but that several feed structures as demonstrated in the example of FIG. 4 could be employed to couple the outer conductors of the respective coaxial feedhorn antennas 202, 204, 206, and 208 to high power amplifiers, such as through switching networks. FIG. 5 demonstrates that a given amount of power is available from the X-band feed assembly 212 to the outer coaxial horn portions of the coaxial feedhorn antennas 202, 204, 206, and 208 in any combination desired for propagation of X-band signals. For example, the coaxial feedhorn antenna 202 may propagate X-band circularly polarized signals at all of the available power while the coaxial feedhorn antennas 204, 206, and 208 are allocated no power. Alternatively, two of the coaxial feedhorn antennas 202, 204, 206, and 208 may be allocated half of the available power each, or all of the coaxial feedhorn antennas 202, 204, 206, and 208 may be allocated a quarter of the available power each.

In a likewise manner, the Ka-band feed assembly 214 is demonstrated as coupled to the inner horn portion of each of the respective coaxial feedhorn antennas 202, 204, 206, and 208. As such, FIG. 5 demonstrates that a given amount of power is available from the Ka-band feed assembly 214 to the inner horn portions of the coaxial feedhorn antennas 202, 204, 206, and 208 in any combination desired for propagation of Ka-band signals. For example, the coaxial feedhorn antenna 202 may propagate Ka-band left-hand and/or right-hand circularly polarized signals at all of the available power while the coaxial feedhorn antennas 204, 206, and 208 are allocated no power. Alternatively, two of the coaxial feedhorn antennas 202, 204, 206, and 208 may be allocated half of the available power each, or each of the coaxial feedhorn antennas 202, 204, 206, and 208 may be allocated a quarter of the available power each. As an example, the available power from the Ka-band feed assembly 214 could be 5500 watts CW power, such that up to 5500 watts can be allocated to a single one of the coaxial feedhorn antennas 202, 204, 206, and 208, or divided in any combination between them as desired.

Accordingly, the example of FIG. 5 demonstrates that each of the coaxial feedhorn antennas 202, 204, 206, and 208 are capable of operating at a dynamic range of power, including high-power. Because the conductive choke-ring 210 of each of the coaxial feedhorn antennas 202, 204, 206, and 208 is a solid construction that is continuously conductively coupled to the outer coaxial horn portion, the conductive choke-ring 210 is capable of providing substantially equal E-plane and H-plane radiation patterns at high-powered transmissions without arcing. For example, in the example of FIG. 5, a given one of the coaxial feedhorn antennas 202, 204, 206, and 208 is capable of X-band circularly polarized uplink and/or downlink signals that have substantially equal E-plane and H-plane radiation patterns while Ka-band circularly polarized uplink and/or downlink signals can be transmitted and/or received at up to 5500 watts CW power.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A coaxial feedhorn antenna for a satellite communication system comprising:

an outer conductive wall;

an inner conductive wall coaxial with the outer conductive wall, the inner conductive wall and the outer conductive wall defining an outer coaxial horn portion for propagation of first signals therebetween, and the inner conductive wall defining an inner horn portion for propagation of second signals within the inner conductive wall, the outer coaxial horn portion and the inner horn portion each comprising an aperture at an end portion of the coaxial feedhorn antenna; and a conductive choke-ring coupled to the outer conductive wall, the conductive choke-ring being coaxial with the outer conductive wall and the inner conductive wall, the conductive choke-ring providing substantially equal E-plane and H-plane radiation patterns of the first signals and substantially reduced back-lobes.

2. The coaxial feedhorn antenna of claim 1 wherein the outer conductive wall and the inner conductive wall are each cylindrical.

3. The coaxial feedhorn antenna of claim 1, wherein the first signals are X-band signals and the second signals are Ka-band signals.

4. The coaxial feedhorn antenna of claim 1, wherein the inner horn portion is configured to at least one of transmit and receive the second signals propagated at a continuous wave (CW) power of less than or equal to about 5500 watts.

5. The coaxial feedhorn antenna of claim 1, wherein the conductive choke-ring comprises an end wall and an annular side wall, the end wall, the annular side wall, and the outer conductive wall defining an annular cavity having an opening that shares an axial direction with the aperture of each of the outer coaxial horn portion and the inner horn portion.

6. The coaxial feedhorn antenna of claim 5, wherein the conductive choke-ring further comprises a plurality of annular side walls, the plurality of annular side walls and the end wall defining a plurality of concentric annular cavities.

7. The coaxial feedhorn antenna of claim 6, wherein each of the plurality of concentric annular cavities has a distinct depth configured to increase a bandwidth associated with the first signals.

8. The coaxial feedhorn antenna of claim 1, further comprising a plurality of conductive choke-rings rings defining a plurality of concentric annular cavities, each of the plurality of conductive choke-rings being coaxial with the outer conductive wall of the coaxial feedhorn antenna and sharing a common annular sidewall with another conductive choke-ring of the plurality of conductive choke-rings.

9. The coaxial feedhorn antenna of claim 8, wherein each of the plurality of concentric annular cavities has a distinct depth configured to increase a bandwidth associated with the first signals.

10. The coaxial feedhorn antenna of claim 1, wherein the outer coaxial horn portion is operative to both transmit and receive the first signals, and the inner horn portion is operative to both transmit and receive the second signals.

11. The coaxial feedhorn antenna of claim 1, wherein the conductive choke-ring is coupled to an outer surface of the outer conductive wall.

12. The coaxial feedhorn antenna of claim 1, wherein the inner horn portion is coupled to an antenna feed system configured to at least one of transmit and receive the second signals propagated at a CW power of less than or equal to 5500 watts.

13. A satellite communication system comprising:

a plurality of coaxial feedhorn antennas, each of the plurality of coaxial feedhorn antennas being operative to receive uplink signals and transmit downlink signals, at least one of the coaxial feedhorn antennas comprising:

an outer coaxial horn portion operative to propagate first signals;

an inner horn portion operative to propagate second signals, the inner horn portion being coaxial with the outer coaxial horn portion; and a conductive choke-ring coupled to the outer coaxial horn portion, the conductive choke-ring being coaxial with the inner horn portion and the outer coaxial horn portion, the conductive choke-ring providing substantially equal E-plane and H-plane radiation patterns of the first signals and substantially reduced back-lobes.

14. The satellite communication system of claim 13, wherein the outer coaxial horn portion is operative to receive and transmit the first signals, and wherein the inner horn portion is operative to at least one of receive and transmit the second signals.

15. The satellite communication system of claim 13, wherein the inner horn portion is configured to at least one of transmit and receive the second signals propagated at a continuous wave (CW) power of less than or equal to about 5500 watts.

16. The satellite communication system of claim 13, wherein the first signals comprise first uplink signals and first downlink signals, and the second signals comprise at least one of second uplink signals and second downlink signals.

17. The satellite communication system of claim 16, wherein power associated with the second signals is distributed to the respective inner horn portion of each of the plurality of coaxial feedhorn antennas, and power associated with the first signals is distributed to the respective outer coaxial horn portion of each of the plurality of coaxial feedhorn antennas.

18. The satellite communication system of claim 13, wherein the first signals are X-band signals and the second signals are Ka-band signals.

19. The satellite communication system of claim 13, wherein the at least one coaxial feedhorn antenna further comprises a plurality of conductive choke-rings rings defining a plurality of concentric annular cavities, each of the plurality of conductive choke-rings being coaxial with the outer conductive wall of the coaxial feedhorn antenna and sharing a common annular sidewall with another conductive choke-ring of the plurality of conductive choke-rings.

20. The satellite communication system of claim 19, wherein each of the plurality of annular cavities has a distinct depth configured to increase a bandwidth associated with the first signals.

21. The satellite communication system of claim 13, wherein the conductive choke-ring is coupled to an outer surface of the outer coaxial horn portion feedhorn.

22. The satellite communication system of claim 13, further comprising a plurality of antenna feed systems, each of the plurality of antenna feed systems being coupled to the inner horn portion of a respective one of the plurality of coaxial feedhorn antennas and being operative to at least one of transmit and receive the second signals propagated at a CW power of less than or equal to 5500 watts.

23. A coaxial feedhorn antenna for a satellite communication system comprising:

an outer conductive wall;

an inner conductive wall coaxial with the outer conductive wall, the inner conductive wall and the outer conductive wall defining an outer coaxial horn portion for propagation of first signals therebetween, and the inner conductive wall defining an inner horn portion for propagation of second signals within the inner conductive wall, the outer coaxial horn portion and the inner horn portion each comprising an aperture at an end portion of the coaxial feedhorn antenna; and a plurality of conductive choke-rings, each of the plurality of conductive choke-rings being coaxial with the outer conductive wall and the inner conductive wall and comprising an end wall and an annular side wall, the end walls and the annular side walls defining a plurality of annular cavities having an opening that shares an axial direction with the aperture of each of the outer coaxial horn portion and the inner horn portion, the plurality of conductive choke-rings providing substantially equal E-plane and H-plane radiation patterns of the first signals and substantially reduced back-lobes.

24. The coaxial feedhorn antenna of claim 23, wherein each of the plurality of annular cavities has a distinct depth configured to increase a bandwidth associated with the first signals.

25. The coaxial feedhorn antenna of claim 23, wherein the inner horn portion is configured to at least one of transmit and receive the second signals propagated at a continuous wave (CW) power of less than or equal to about 5500 watts.

26. The coaxial feedhorn antenna of claim 23, wherein the outer coaxial horn portion is operative to both transmit and receive the first signals, and the inner horn portion is operative to both transmit and receive the second signals.

27. The coaxial feedhorn antenna of claim 23, wherein the conductive choke-ring is coupled to an outer surface of the outer conductive wall.

28. The coaxial feedhorn antenna of claim 23, wherein the inner horn portion is coupled to an antenna feed system configured to at least one of transmit and receive the second signals propagated at a CW power of less than or equal to 5500 watts.

* * * * *